US005109741A

United States Patent [19]

Fuchs

[11] Patent Number: 5,109,741

[45] Date of Patent: May 5, 1992

[54] KNIFE ROLLER

[75] Inventor: Siegfried Fuchs, Neuwied, Fed. Rep. of Germany

[73] Assignee: Winkler & Duennebier Maschinenfabrik und Eisengiesserei KG, Neuwied, Fed. Rep. of Germany

[21] Appl. No.: 628,213

[22] Filed: Dec. 17, 1990

[30] Foreign Application Priority Data

Jan. 3, 1990 [DE] Fed. Rep. of Germany ..... 4000078

[51] Int. Cl.[5] ..... B26D 7/18; B26F 1/38; B31B 19/14

[52] U.S. Cl. ..... 83/100; 83/152; 83/346; 83/669; 83/911

[58] Field of Search ..... 83/24, 100, 152, 669, 83/670, 698, 911, 346

[56] References Cited

U.S. PATENT DOCUMENTS

| | | | |
|---|---|---|---|
| 3,172,321 | 3/1965 | Schrader | 83/100 |
| 3,380,327 | 4/1968 | Stemmler | 83/100 |
| 3,782,166 | 1/1974 | Whistler, Jr. et al. | 83/698 X |
| 4,537,588 | 8/1985 | Ehlscheid et al. | 493/342 |
| 4,671,152 | 6/1987 | Blumle | 83/152 |
| 4,823,659 | 4/1989 | Falasconi | 83/100 |
| 4,993,293 | 2/1991 | Christoffersson et al. | 83/24 X |

FOREIGN PATENT DOCUMENTS

| | | |
|---|---|---|
| 0342776 | 11/1989 | European Pat. Off. . |
| 1209414 | 1/1966 | Fed. Rep. of Germany . |
| 1436912 | 3/1969 | Fed. Rep. of Germany . |
| 2151218 | 5/1972 | Fed. Rep. of Germany . |
| 2164554 | 6/1973 | Fed. Rep. of Germany . |
| 3605085 | 8/1987 | Fed. Rep. of Germany . |
| 3711824 | 10/1987 | Fed. Rep. of Germany . |
| 3730810 | 3/1989 | Fed. Rep. of Germany . |

*Primary Examiner*—Frank T. Yost
*Assistant Examiner*—Eugenia A. Jones
*Attorney, Agent, or Firm*—W. G. Fasse

[57] ABSTRACT

The invention relates to a knife roller with at least one film knife which is securable on a multi-part roller body, which comprises suction openings around its circumference, and connected thereto, suction channels extending in the lengthwise direction. The gist of the invention is that:

a) suction openings are provided along several suction hole rows arranged next to one another in the circumferential direction, b) one suction channel is arranged to correspond with each suction hole row, and c) at least one suction air control channel and at least one adjustable suction air control disk are provided, d) by means of which the suction air control channel is selectively connectable with different suction channels, suction hole rows, and their suction openings.

9 Claims, 11 Drawing Sheets

KNIFE ROLLER

FIELD OF THE INVENTION

The invention relates to a knife roller with at least one film knife which is securable to a multi-part roller body which comprises suction openings around its circumference and connected thereto suction channels running in the lengthwise direction.

BACKGROUND OF THE INVENTION

A knife roller of the described type is known, for example, from U. S. Pat. No. 4,537,588. It serves to cut out the window in manufacturing windowed letter envelopes. While the letter envelope blank is transported from the knife roller to a further work station, the knife roller must at first hold the scrap waste piece resulting from the window cut-out for a certain period of time and then release it into a suction funnel. In order to achieve this the knife roller comprises suction openings to which vacuum may be applied through a suction channel.

OBJECTS OF THE INVENTION

It is the object of the invention to construct a knife roller for manufacturing letter envelopes and for other applications so that it is usable in a versatile manner and especially is also capable of disposing of more than just one single waste scrap piece in a certain and reliable manner.

SUMMARY OF THE INVENTION

In order to achieve this object the invention provides that suction openings are provided in several suction hole rows and staggered in a circumferential direction so that one suction channel is respectively arranged to cooperate with each suction hole row and that at least one suction air control channel and at least one adjustable suction air control disk are provided by means of which the suction air control channel may be selectively connected with the various suction channels, with the suction hole rows, and with their suction openings.

For example, by using twelve suction hole rows and correspondingly as many suction channels with three suction air control channels and two suction air control disks arranged at the end faces, the above mentioned measures make it possible to certainly and reliably dispose of three different waste scrap pieces which are distributed around the circumference of the knife roller and which must be transported away and then released at exactly the right moment. Hereby, it is further advantageous, that by means of suction openings in the film knife or film knives, respectively only the necessary suction openings of the various suction hole rows are supplied with a vacuum while the other suction openings are covered.

It is possible to carry out a suction air control in the described form independently of whether the film knives are held on the multi-part roller body by means of magnetic bars or by means of a mechanical clamping and securing arrangement.

BRIEF DESCRIPTION OF THE DRAWINGS

The invention will be described in greater detail in the following with reference to example embodiments shown in the accompanying drawings, wherein.

DETAILED DESCRIPTION OF PREFERRED EXAMPLE EMBODIMENTS AND OF THE BEST MODE OF THE INVENTION

Figure 1:
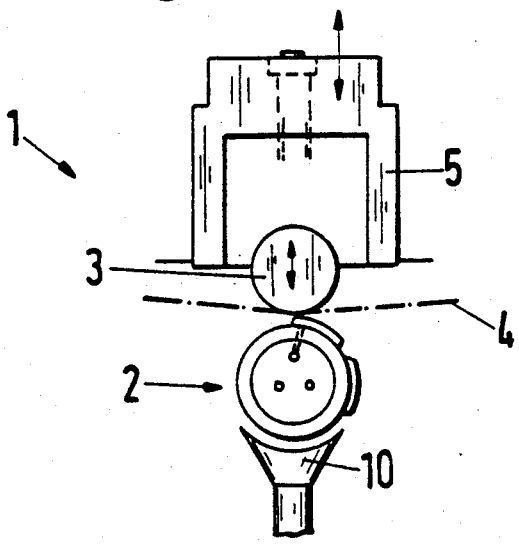
FIG. 1 is a diagrammatic sketch of a cutting station with a knife roller.

According to the example embodiment shown diagrammatically in FIG. 1, a cutting station 1 for windowed letter envelopes comprises a knife-roller or cutting 2 and a rotating counter or anvil roller 3 which serves as a counter tool, between which a paper web 4 which has not yet been separated into letter envelope blanks, is guided through and is then processed. The counter roller 3 is held in a carrier 5 and together therewith is movable in the direction of the arrow toward and away from the knife roller 2. The cutting station la according to FIG. 2 serves for processing letter envelope blanks 4*a*, whereby a cutting bar 3*a* is provided as a counter tool for the knife roller 2. Here again, the cutting bar 3*a*, together with its carrier 5 is adjustable in the direction of the arrows toward and away from the knife roller 2. For taking over and transporting the letter envelope blank 4*a*, the knife roller 2 comprises a suction bar 6 (FIG. 3) with suction openings 7, whereby the suction bar 6 is arranged at a fixed angular position in its phase position relative to the supply and removal rollers 8 and 9.

The letter envelope blank 4*a*, which is gripped by the suction bar 6, is guided along a circular path below the counter tool or the cutting bar 3*a*, whereby a window is cut out. The window cut-out or the scrap piece is held by means of suction air within the window knife periphery and is finally released into a suction funnel 10, while the letter envelope blank 4*a* is further transported away by the removal roller 9.

Figure 2:
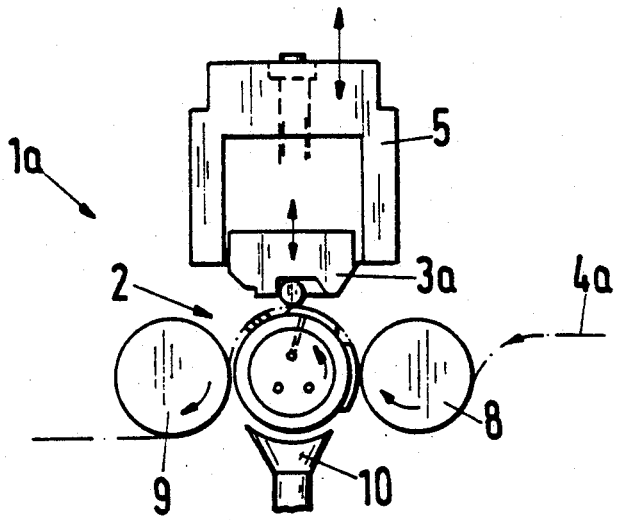
FIG. 2 is a diagrammatic sketch of a modified cutting station.

The cutting out and holding of the window cut-out and finally the release of the scrap piece into the suction funnel 10 is achieved in the cutting station 1 according to FIG. 1 in the same manner and by the same means as in the cutting station 1*a* according to FIG. 2.

Figure 3:
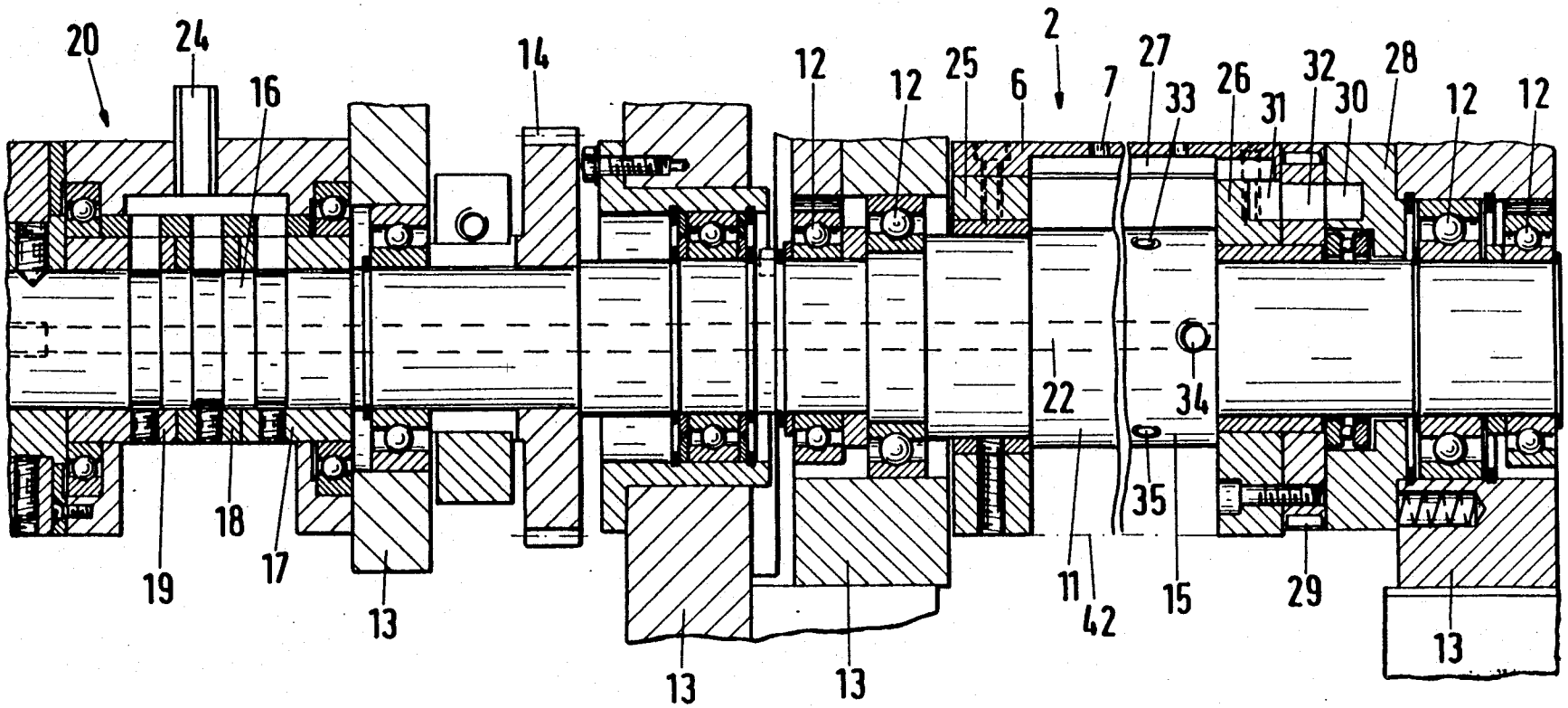
FIG. 3 shows in section the essential components of the knife roller and its bearing support.

FIG. 3 shows the knife roller 2 or its bearing support, as well as the central parts of the knife roller 2 in section, however, without the film knives and without the parts serving to secure and clamp in the film knives.

The knife roller 2 comprises a carrier shaft 11 which is supported by several ball bearings 12 in a machine frame 13 and which is drivable by a gear wheel 14.

Figure 5:
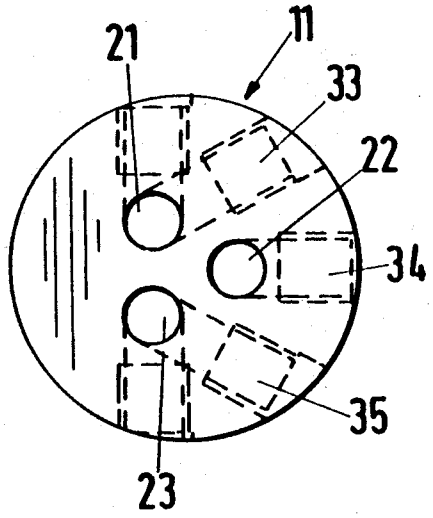
FIG. 5 is a section through the carrier shaft in the area of the film knives.
Figure 4:
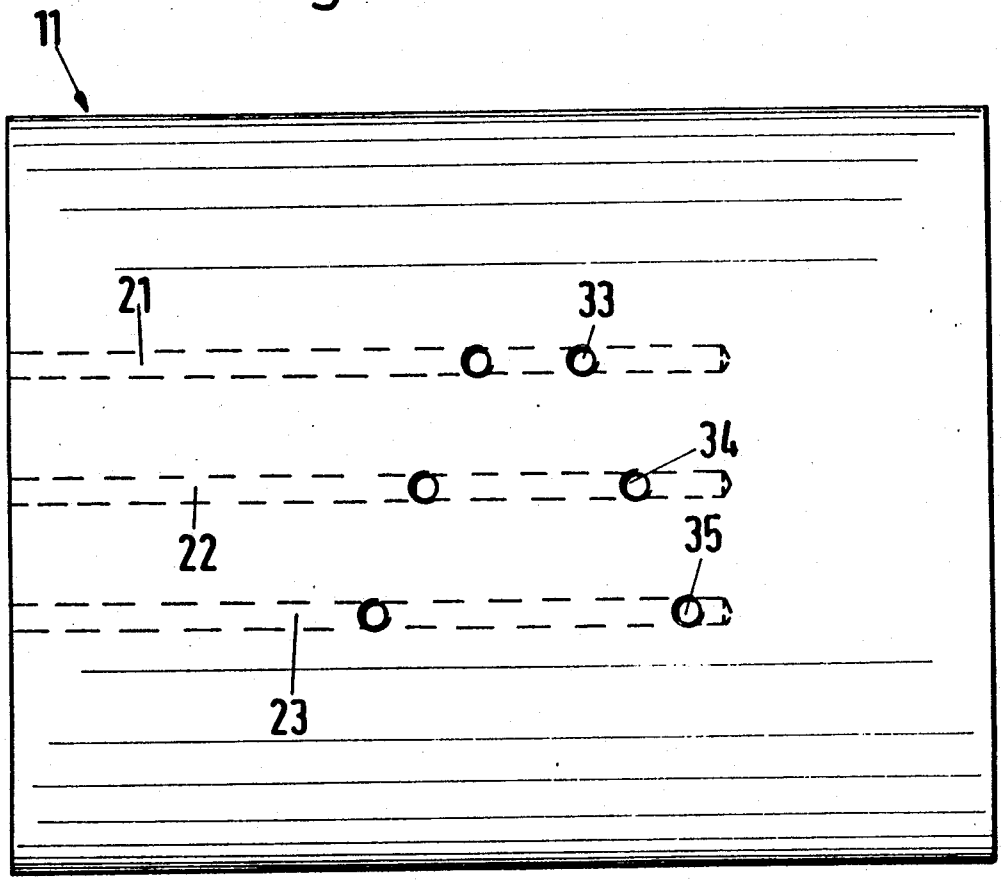
FIG. 4 is a developed view of the carrier shaft of the knife roller in the area of the film knives.

The parts, not shown in FIG. 3, for securing and clamping the film knives, are securable on the carrier shaft 11 close to one of its ends 15 while the other end 16 of the carrier shaft 11 carries control disks 17, 18, and 19 for the suction air control, which belong to a stationary suction air control valve 20. Three lengthwise bored hole or channels 21, 22, and 23 shown in FIGS. 4 and 5, are located in the carrier shaft 11 are supplied with vacuum from a vacuum line 24, through the suction air control valve 20 and its three control disks 17, 18, and 19, depending on the angular position of the carrier shaft 11. Such suction air control valves 20 are known. At its other end 15, the carrier shaft 11 carries a left take-up disk 25 and a right take-up disk 26 for the suction bar 6, which grips a letter envelope blank 4*a* by suction air and for further transporting the blank 4*a*. The suction bar 6 comprises a suction channel 27 under the suction openings 7 for which the suction air supply is provided by a second suction air control valve 28 and a separately adjustable suction air control disk 29. As in the right take-up disk 26 for the suction bar 6, there is located in the suction air control valve 28 one suction air control channel 30 or 31 which are connected to each other according to FIG. 3 when a window 32 located in the suction air control disk 29 is located between the suction air control panels 30 and 31.

The three lengthwise bores or channels 21, 22, and 23 in the carrier shaft 11 open at the shaft end 15 into the crosswise bores 33, 34 and 35 as is also shown in FIG. 3. The position and arrangement of the lengthwise bores 21 to 23 and of the crosswise bores 33 to 35 is also shown in FIGS. 4 and 5.

Figure 9:
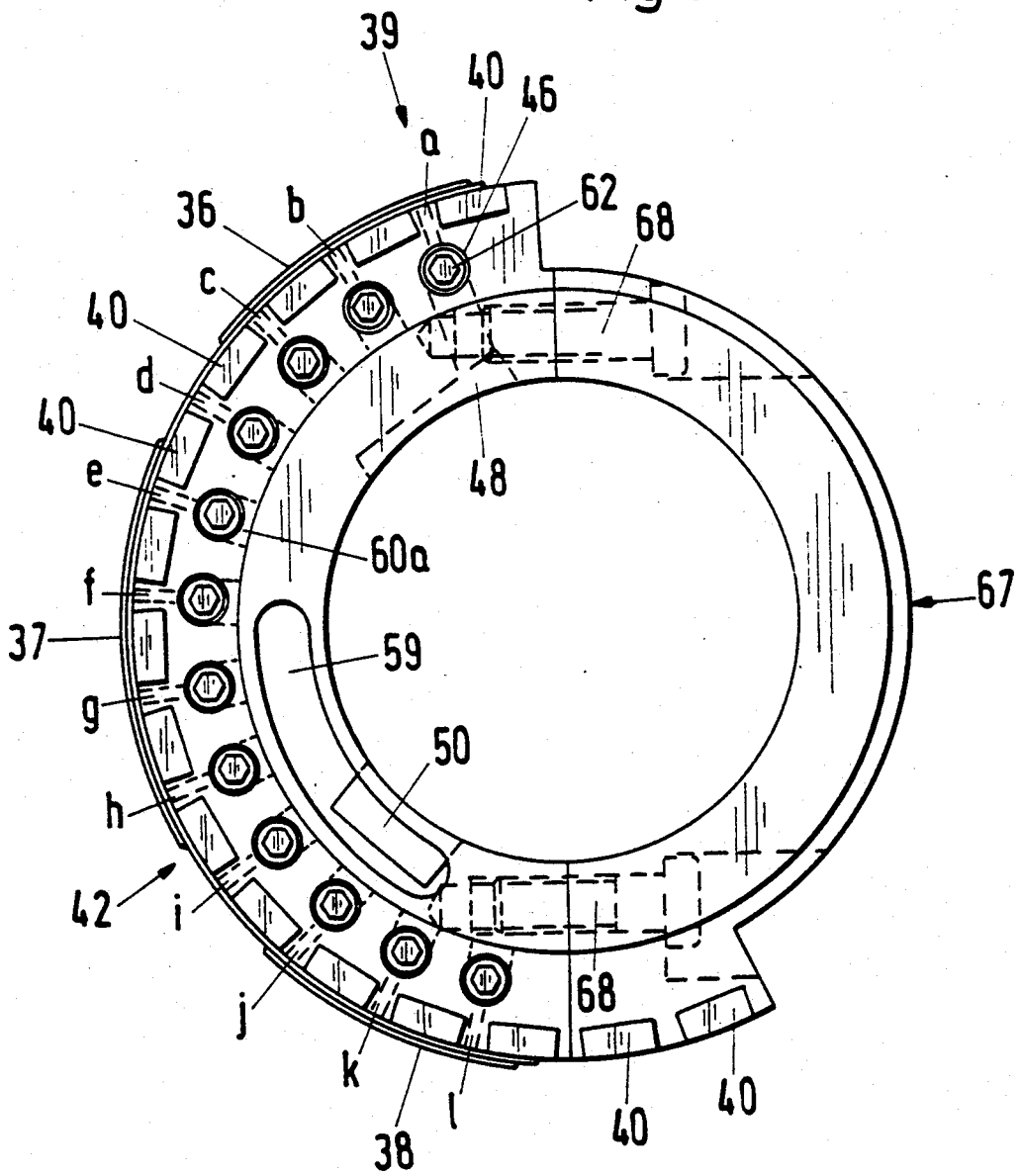
FIG. 9 is an end face view of the magnetic holding and clamping arrangement for the film knives seen from the right side in FIG. 6.
Figure 10:
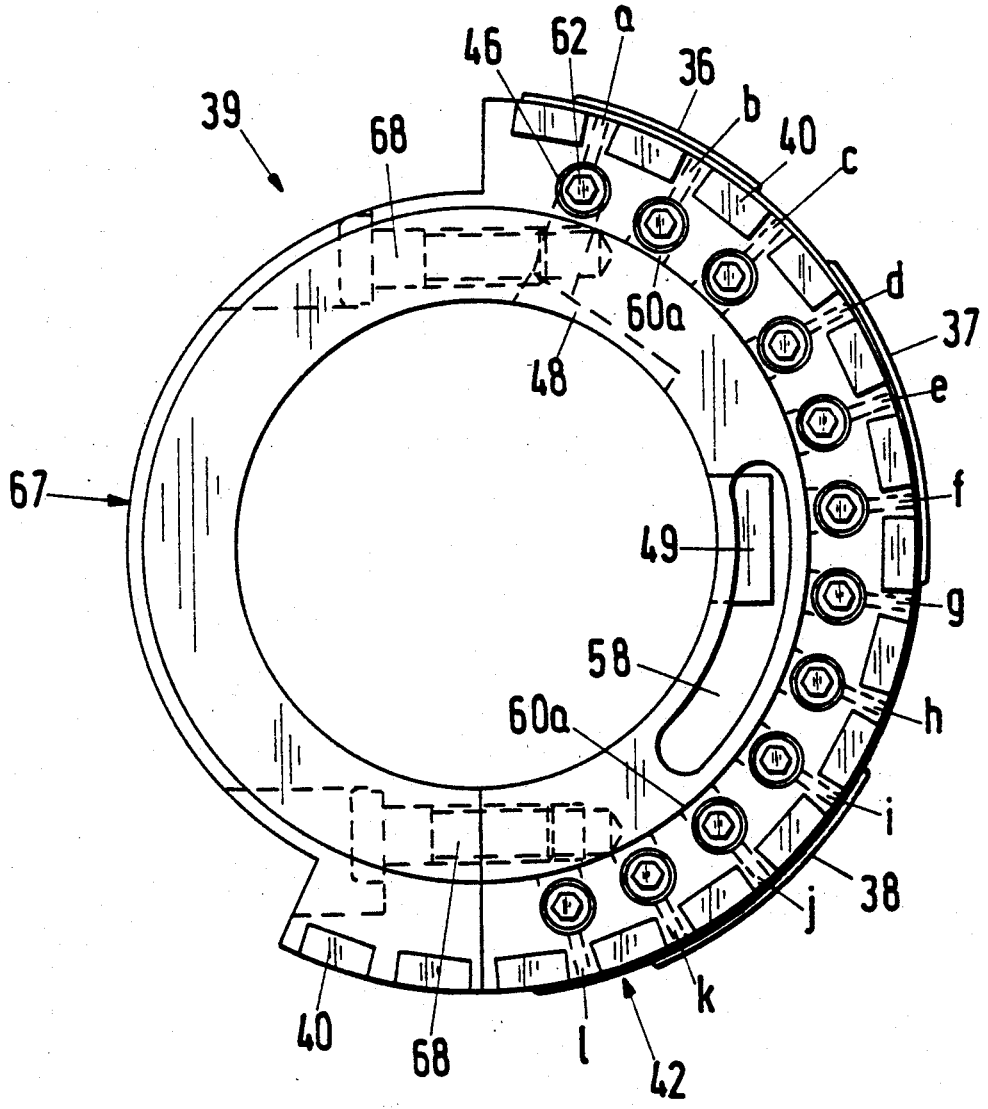
FIG. 10 is an end face view of the magnetic holding and clamping arrangement for the film knives seen from the left side in FIG. 6.
Figure 12:
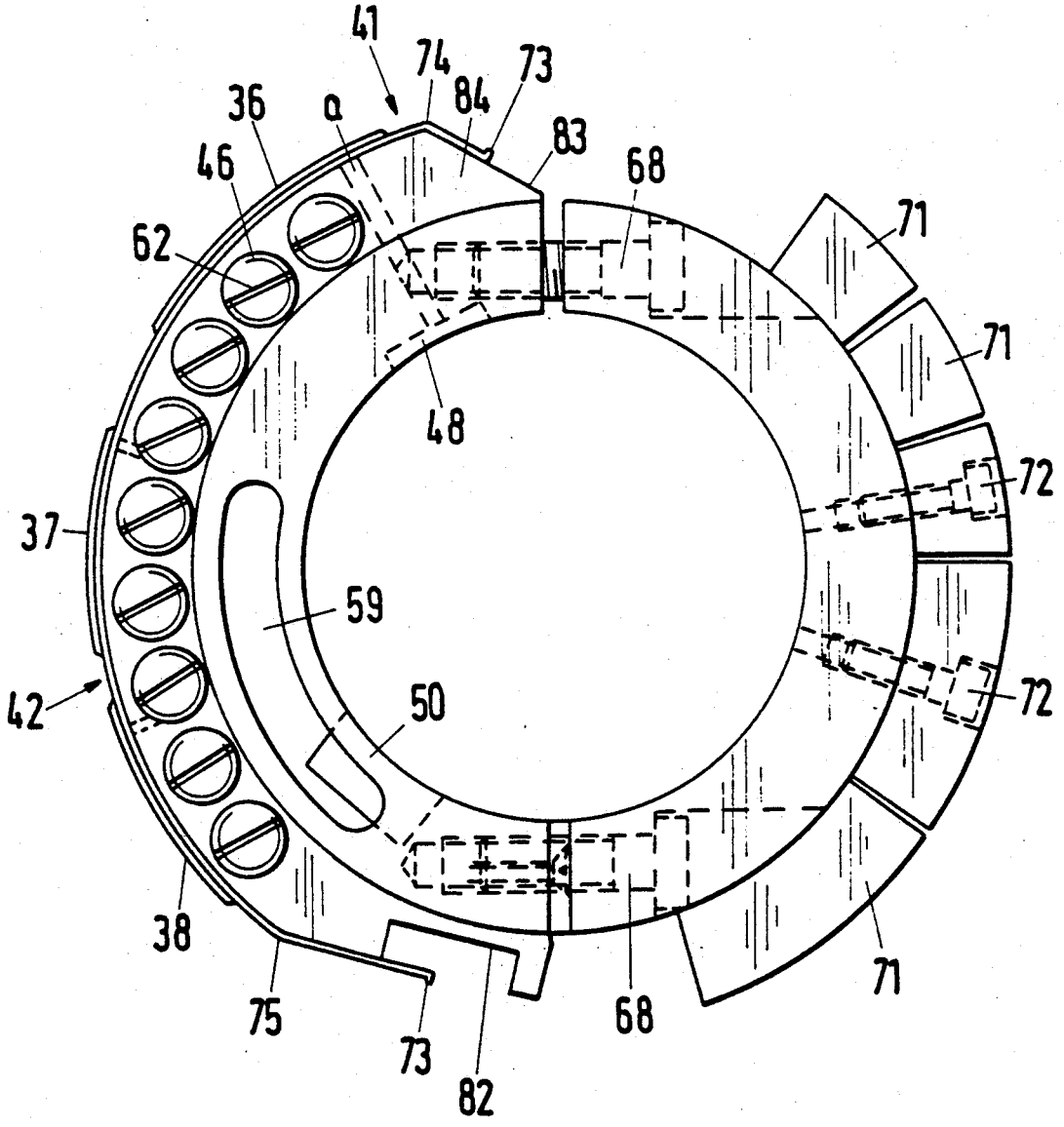
FIG. 12 is an end face view of a mechanical holding and clamping arrangement for the film knives.
Figure 13:
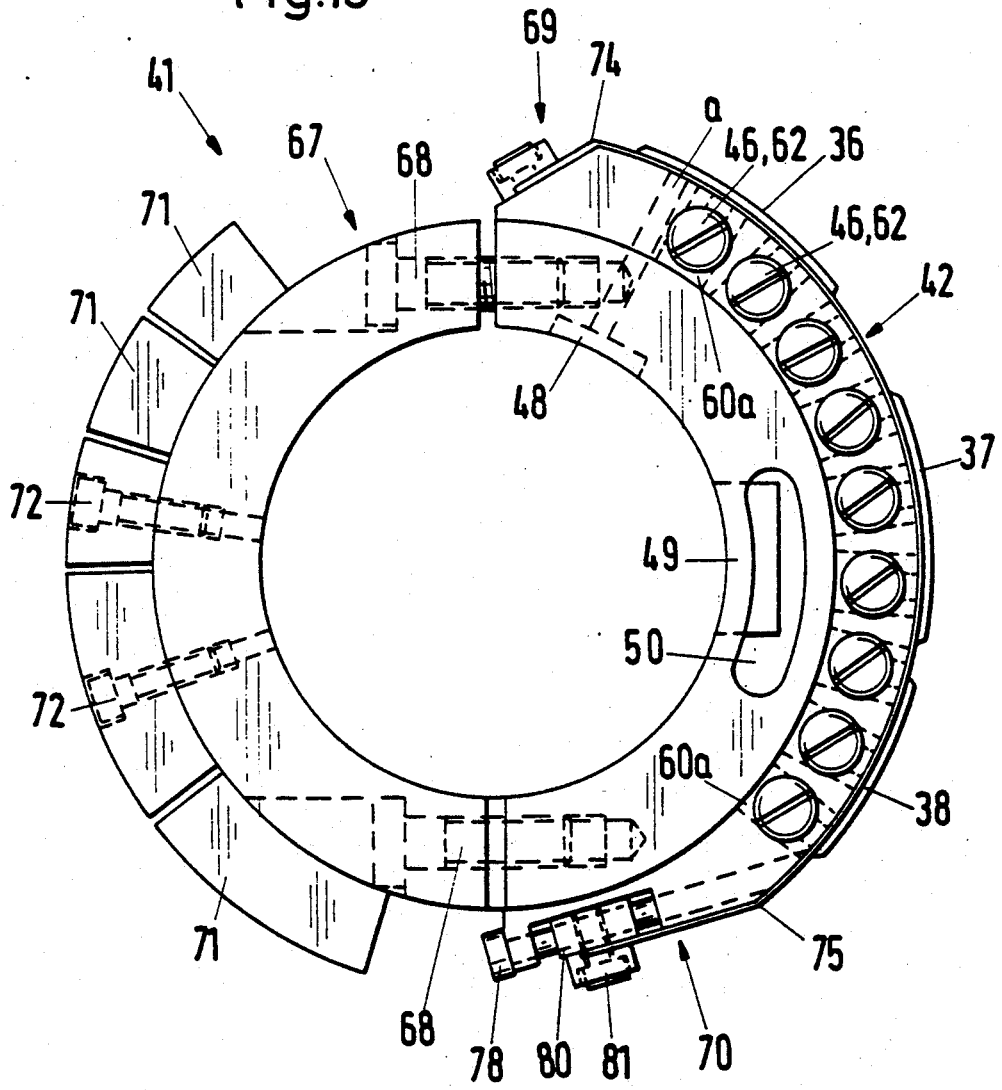
FIG. 13 is an end face view of the mechanical holding and clamping arrangements on the other side of the knife roller.
Figure 14:
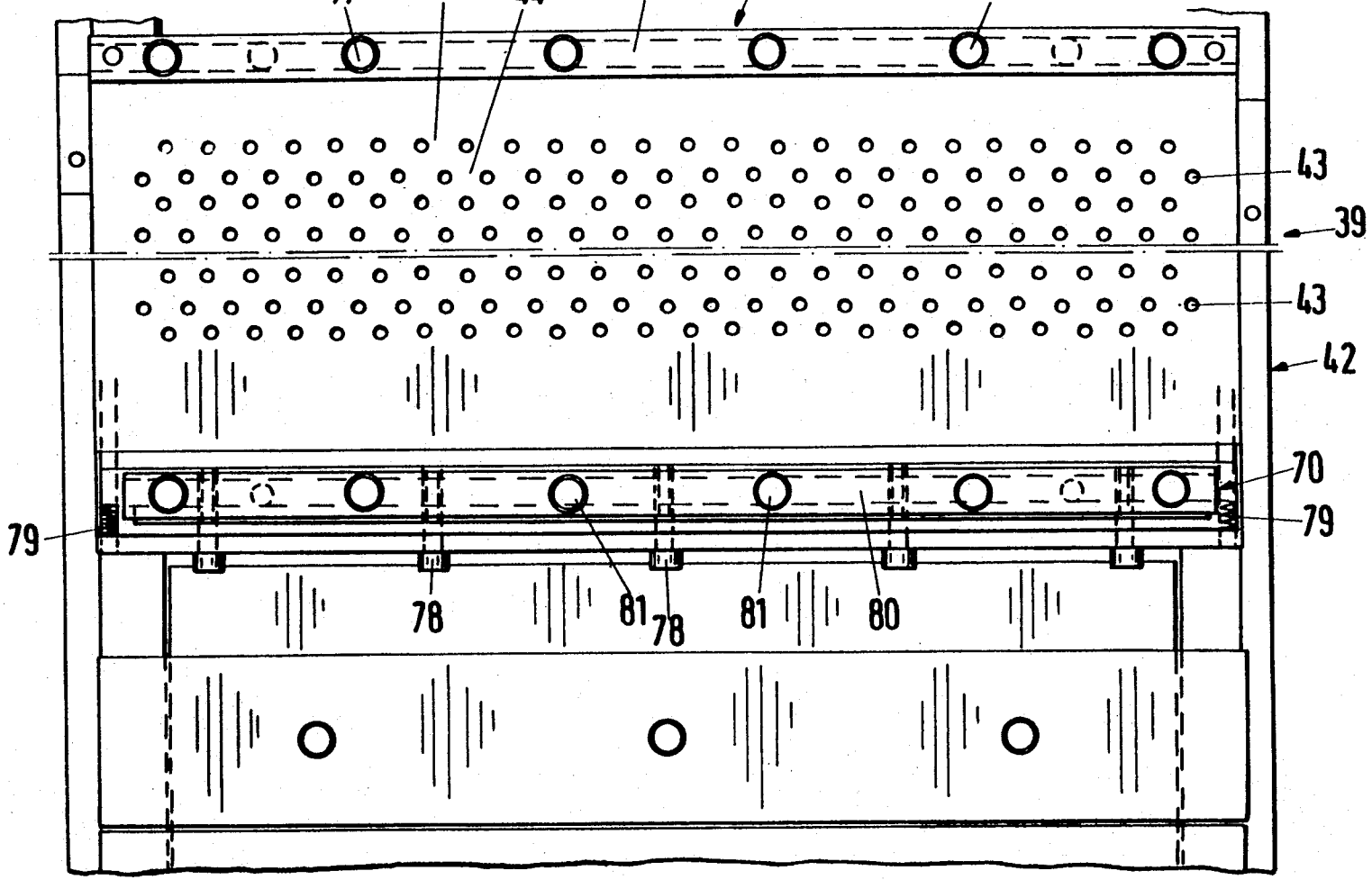
FIG. 14 is a developed view of the mechanical holding and clamping arrangement.

Furthermore, sitting on the right shaft end 15 of the carrier shaft 11 is a holding and clamping arrangement 39 with magnetic bars 40 according to FIGS. 9 and 10, or with a mechanically operating holding and clamping arrangement 41 according to FIGS. 12 to 14 for securing and clamping the film knives 36, 37 and 38. For the sake of clarity these holding arrangements 39 or 41 are only shown in FIGS. 9 and 10 or 12 to 14 and not in FIG. 3.

Figure 6:
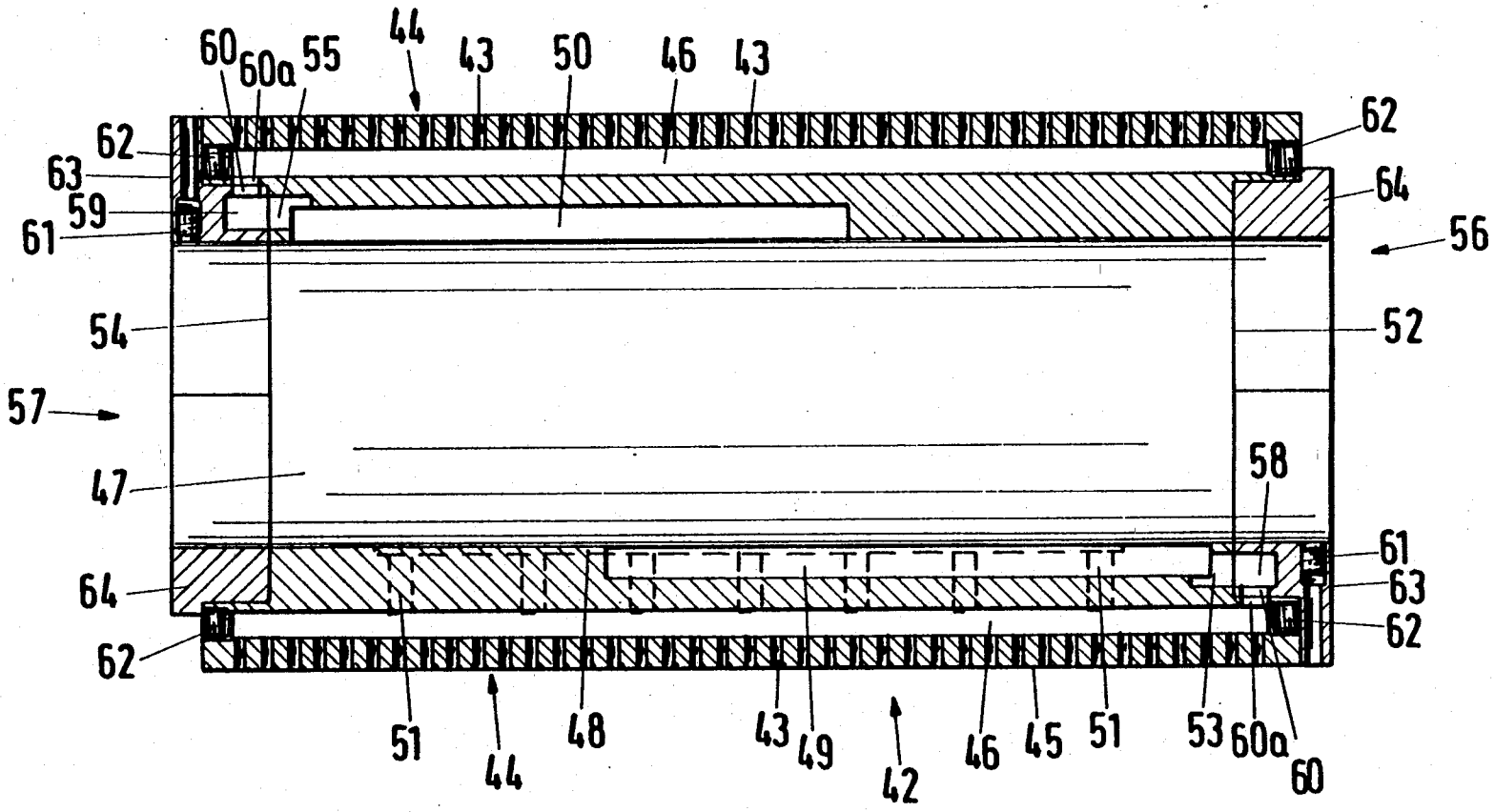
FIG. 6 is a section through parts of the holding and clamping arrangement for the film knives.

FIG. 6 shows in section, parts of the holding and clamping arrangement for the film knives whereby the features shown are equivalent to the holding and clamping arrangement 39 with magnetic bars 40 and to the mechanical holding and clamping arrangement 41.

Figure 11:
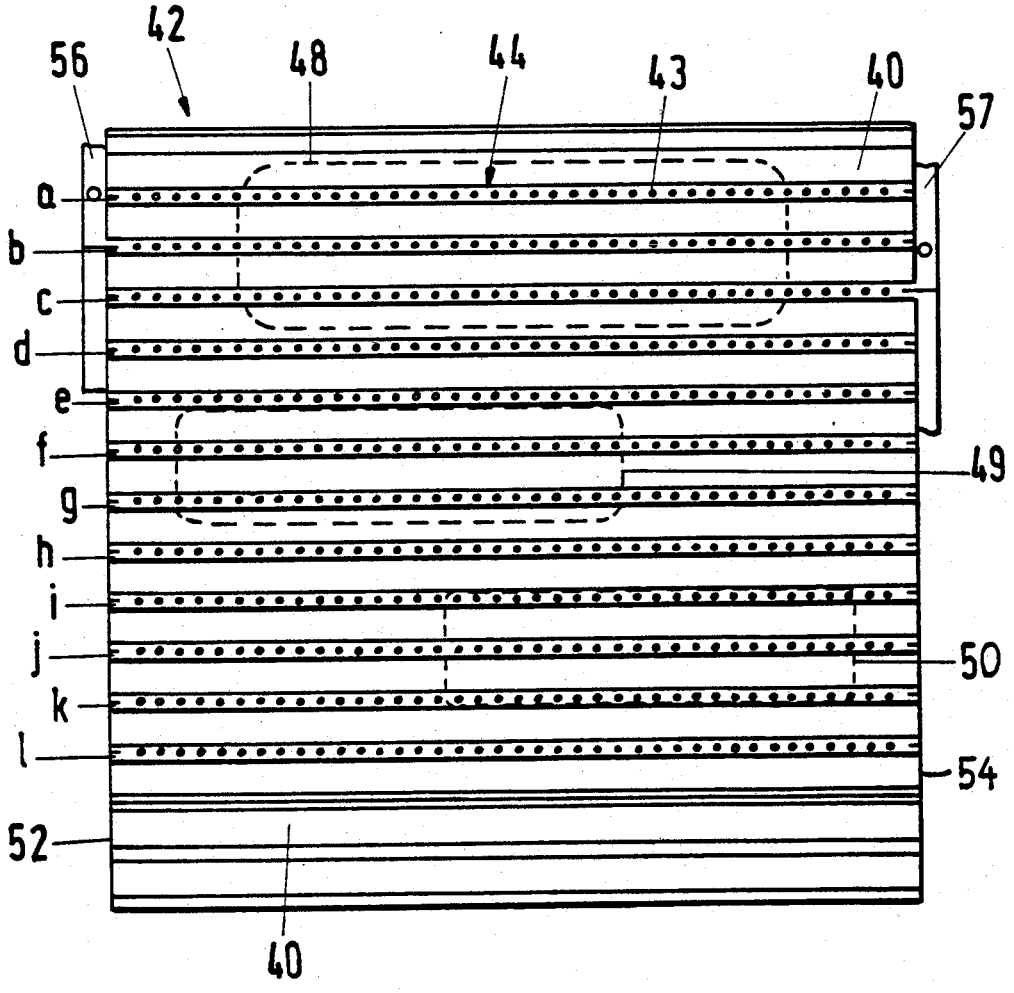
FIG. 11 is a top view of a cylindrical projection of the magnetic holding and clamping arrangement.

According to FIGS. 6, 9, 10, and 12, 13, an approximately semicylindrical shell 42 forms part of each of the holding and clamping arrangements 39, 41. The shell 42 has suction openings 43 forming several suction hole rows 44 for example twelve suction hole rows a to l (FIG. 11). The suction hole rows are spaced in the circumferential direction around the shell 42. The shell 42 at least partially forms the effective roller surface 45 from which the suction openings 43 extend radially inwardly to the suction channels 46 which are arranged directly below the roller surface 45. Furthermore, one suction channel 46 is arranged to cooperate respectively with each suction hole row 44 or suction hole row a to l. All suction hole rows 44 and suction channels 46 extend in parallel to each other and in the roller lengthwise direction.

On its inner side 47 the half cylindrical shell 42 comprises three suction air control channels or ducts 48, 49, and 50 in the form of canal shaped recesses In the assembled state these suction air control channels or ducts 48, 49 and 50 are respectively arranged to cooperate with one of the three crosswise bores 33, 34 or 35 in the carrier shaft 11.

Figure 7:
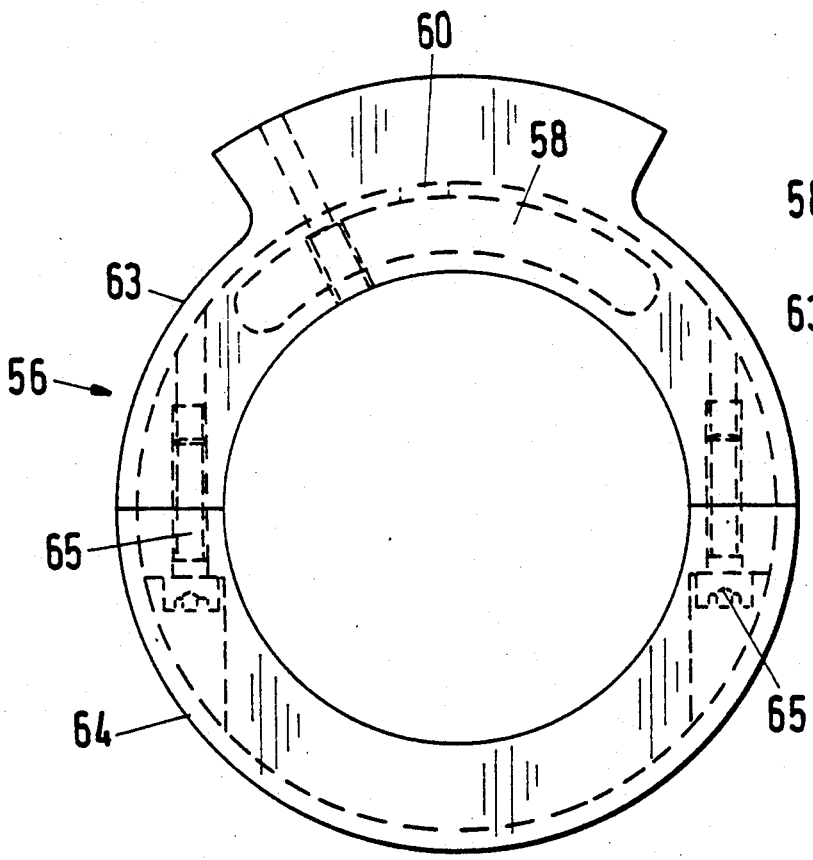
FIG. 7 is an end face view of an adjustable suction air control disk on the knife roller.
Figure 8:
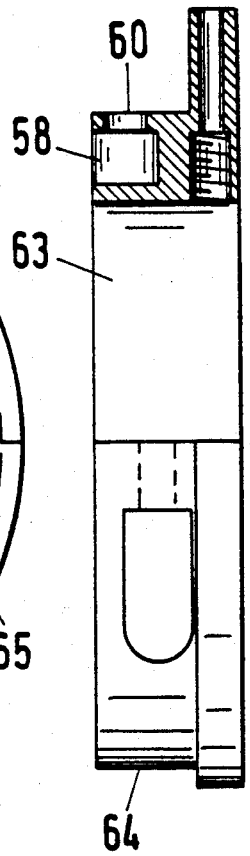
FIG. 8 is a side view of the suction air control disk according to FIG. 7 shown partially in section.

The first suction air control channel 48 is, as can also be seen in FIG. 6, connected to the first suction hole row a by way of crosswise bored holes 51. The second suction air control channel 49 also extends parallel to the suction channels 44 over slightly more than half of the shell length and ends at its one end face 52 with a control window or opening 53. Essentially the same holds true for the third suction air control channel 50 which, however, ends with a control window or opening 55 at the other end face 54 of the shell 42. Further, suction air control or valving disks 56 or 57, each having a control channel 58 or 59, and from each of which branches off a radially outwardly directed control window 60 are located at both end faces 52 and 54. By means of the control channels 58 or 59 and the respective control windows 60 in the suction air control disks 56, 57 and a respective further control window 60*a* directed radially inwardly to the control window 60 and extending out from each radial suction channel 46, the suction air control channels 49, 50 are selectively connectable with the suction channels 46 of the respective suction hole rows 44 by adjusting the suction air control or valving disks 56, 57. The suction air control disks 56, 57 are fixed on the carrier shaft 11 by means of clamping screws 61, and closure screws 62 are provided for closing the facing ends of the suction channels 46. The two suction air control or valving disks 56, 57 are essentially equivalently shaped and for assembly reasons are made of two pieces as can be seen from FIGS. 7 and 8. Their two halves 63, 64 are held together by means of clamping screws 65. Furthermore, both suction air control disks 56 and 57 are ring-shaped as can be seen from FIGS. 6 to 8.

The approximately semicylindrical shell 42 not only partly forms the roller surface 45, but also serves as a carrier of the film knives 36, 37, and 38. According to the example embodiments shown in FIGS. 9 and 10, or 11, magnetic bars 40 are provided for securing and clamping-in the film knives 36, 37 and 38. They lie parallel to the roller lengthwise axis as well as between the suction hole rows a to l. Magnetic bars 40 are also provided outside of the suction hole row 44 in a sufficient number to give the film knives 36 to 38 a secure hold.

The developed view of FIG. 11 shows the suction air control channel 48 approximately centered in the shell 42 with equal spacings from each shell end, while the second suction air control channel 49 is shifted more to the left, and the third suction air control channel 50 is shifted more to the right. Further, the second suction air control channel 49 is open to the left end face 52, while the third suction air control channel 50 is open to the right-end face 54.

A similarly semicylindrical fitting piece 67 serves for securing the semicylindrical shell 42 on the carrier shaft 11 as can be seen in FIGS. 9 and 10. The semicylindrical shell 42 and the semicylindrical fitting piece 67 are securely and rigidly fixed, for example, by means of screws 68, to each other as well as to the carrier shaft 11.

The mechanical holding and clamping arrangement 41 according to FIGS. 12 to 14, differs from the holding and clamping arrangement 39 according to FIGS. 9 to 11, essentially only in that the magnetic bars 40 for securing and holding the film knives 36, 37, and 38, are replaced by mechanical holding and clamping means 69 or 70.

Corresponding to the embodiment according to FIGS. 9 to 11, the holding and clamping arrangement 41 comprises a semicylindrical shell 42 and a semicylindrical fitting piece 67 which are securable by screws 68 to each other and to the carrier shaft 11. Furthermore, FIGS. 12 and 13 show compensating balance weights 71 on the fitting piece 67. Such compensating balance weights 71 are similarly required in the holding and clamping arrangement 39 according to FIGS. 9 and 10 and they are also secured by means of screws 72 on the fitting piece 67 even though this is not shown in FIGS. 9 and 10.

The semicylindrical shell 42 of the mechanical holding and clamping arrangement 41 serves for the securing of one or more film knives 36, 37 or 38. In order to achieve this at least one clamping lip 73 is located at the ends of each film knife or film knives so that the film knife or film knives 36 to 38 may be adjustably fixed in the circumferential direction with their one end 74 rigidly held on the semicylindrical shell 42 and with their other end 75 fixed by means of the holding and clamping elements 69, 70, respectively located there.

The rigidly acting holding and clamping means 69 comprise a clamping bar 76 and securing screws 77. The adjustable holding and clamping means 70 comprise clamping screws 78 and a clamping slide 80 biased by springs 79 shown in FIG. 14. The film knife or film knives are hanged by means of their clamping lips 73 onto the clamping slide 80 and are secured by clamping screws 81.

As especially shown in FIG. 12, a clamping channel 82 in the shell 42 serves for receiving the clamping slide 80. The rigidly secured end 74 of the film knife or film knives 36 or 38 lies with its clamping lip 73 preferably on an inclined surface 83 or on an edge piece 84 of the shell 42 having a wedge-shaped cross-section as may similarly be seen from FIG. 12.

Although the invention has been described with reference to specific example embodiments it will be appreciated that it is intended to cover all modifications and equivalents within the scope of the appended claims.

What I claim is:

1. A knife roller for cutting out several openings in flat material and for disposing of cut-out portions, comprising a roller cylinder body having a longitudinal roller axis, a shell section (42) surrounding at least a portion of said roller cylinder body, cutting knives secured to said shell section, a plurality of suction holes (43) passing through said shell section, said suction holes (43) being arranged in rows (44) extending in parallel to said longitudinal roller axis, said rows (44) being circumferentially spaced from one another around said shell (42), a plurality of suction channels (46) arranged so that one suction channel (46) is provided in common for all suction holes (43) of one suction hole row (44), whereby each suction hole row (44) has its own suction channel (46), said suction channels (46) extending in parallel to said longitudinal roller axis, a first suction air control duct (48) exclusively communicating with a first suction channel (44*a*) of said plurality of suction channels (46), second and third suction air control ducts (49, 50), a first valving disk (6) arranged for communicating said second suction air control duct (49) with any one of said plurality of suction channels (46) except said first suction channel (44*a*), a second valving disk (57) arranged for communicating said third suction air control duct (50) with anyone of said plurality of suction channels (46) except said first suction channel (44*a*), flow conduit means for providing communication from a source of suction to said suction holes (43) through said suction channels (46), and through said suction air control ducts (48, 49, 50) of which said second and third ducts are selectively controlled by said first and second valving disks (56, 57), whereby substantially any surface portion of said shell section is selectable for an application of suction through the suction holes in said surface portion.

2. The knife roller of claim 1, wherein said first and second valving disks (56, 57) are ring-shaped.

3. The knife roller of claim 1, wherein said shell section (42) has a roller surface (45) into which said suction holes (43) open, said suction channels (46) being arranged below said roller surface (45) in said shell section (42).

4. The knife roller of claim 1, further comprising a carrier shaft (11) for carrying said knife roller, said flow conduit means including three lengthwise bores (21, 22, 23) through said carrier shaft and crosswise bores (33, 34, 35) connecting to said first, second, and third suction air control ducts (48, 49, 50), and a suction air control valve (20) including three control disks (17, 18, 19)arranged to correspond with said three lengthwise bores (21, 22, 23) through said carrier shaft (11).

5. The knife roller of claim 4, wherein said shell section is semicylindrical, said roller further comprising means for securing said semicylindrical shell section to said carrier shaft.

6. The knife roller of claim 4, wherein said first suction air control duct(48) exclusively communicating with said first suction channel (a) is constantly connected to its respective lengthwise bore 921) in said carrier shaft (11) for holding a first cut-out scrap piece.

7. The knife roller of claim 1, wherein said first, second, and third suction air control ducts (48, 49, 50) cooperate with said suction holes in selected surface portions of said shell section (42) for holding cut-out scrap pieces.

8. The knife roller of claim 1, wherein said flow conduit means comprise radially directed bores (51) connecting said first suction air control duct (48) to said first suction channel (a), wherein said flow conduit means further comprise a flow control window (53) at one end of said second suction air control duct (49), and wherein said flow conduit means comprise a further flow control window (55) at one end of said third suction air control duct (50).

9. The knife roller of claim 1, wherein said suction holes (43) are arranged to form a group of twelve of said suction hole rows (44*a* to 44*l*), said first suction channel (44*a*) communicating exclusively with a first row (44*a*) of said suction hole rows extending along a longitudinal edge of said shell section (42).

* * * * *